US008807502B2

(12) United States Patent
Bixler

(10) Patent No.: US 8,807,502 B2
(45) Date of Patent: Aug. 19, 2014

(54) ADJUSTABLE FASTENER

(76) Inventor: Joshua E. Bixler, Bethesda, MD (US)

( * ) Notice: Subject to any disclaimer, the term of this patent is extended or adjusted under 35 U.S.C. 154(b) by 116 days.

(21) Appl. No.: 13/533,612

(22) Filed: Jun. 26, 2012

(65) Prior Publication Data

US 2013/0341477 A1 Dec. 26, 2013

(51) Int. Cl.
*A47F 1/10* (2006.01)

(52) U.S. Cl.
USPC ..... 248/295.11; 248/476; 248/495; 248/496; 40/748; 40/757; 40/759

(58) Field of Classification Search
USPC ..... 248/295.11, 496, 476, 477, 297.3, 248/222.2, 222.3, 478, 490, 489, 495, 248/475.1; 24/713, 745, 748, 757, 759
See application file for complete search history.

(56) References Cited

U.S. PATENT DOCUMENTS

| | | | | |
|---|---|---|---|---|
| 4,557,455 | A * | 12/1985 | Benjamin | 248/496 |
| 5,584,462 | A * | 12/1996 | Reese | 248/477 |
| 6,126,122 | A * | 10/2000 | Ismert | 248/74.1 |
| 6,185,831 | B1 | 2/2001 | Pluciennik | |
| 6,446,915 | B1 * | 9/2002 | Ismert | 248/68.1 |
| 6,666,425 | B1 | 12/2003 | Ferguson | |
| 6,957,797 | B1 | 10/2005 | Strobel | |
| 7,201,357 | B2 | 4/2007 | Price et al. | |
| 7,234,671 | B2 | 6/2007 | Avinger | |
| 2007/0075211 | A1 * | 4/2007 | Potter | 248/476 |
| 2009/0188121 | A1 | 7/2009 | Rabin | |
| 2009/0294616 | A1 * | 12/2009 | Eriksson-Bradley et al. | 248/305 |

FOREIGN PATENT DOCUMENTS

WO 2004004519 A1 1/2004

* cited by examiner

*Primary Examiner* — Todd M Epps
(74) *Attorney, Agent, or Firm* — Panitch Schwarze Belisario & Nadel LLP

(57) ABSTRACT

An adjustable fastener includes a base configured to be fixedly attached to a structure. The base defines a longitudinally extending channel therein. At least a portion of the channel has a plurality of spaced-apart ribs or teeth extending inwardly into the channel. A carriage is movably attached to the base. The carriage is directly attachable to at least a portion of an object. The carriage includes at least two laterally spaced-apart elongated extensions. Each extension has a plurality of complimentary spaced-apart ribs or teeth for engaging the plurality of ribs or teeth of the base to locate and retain the elongated extensions within the channel of the base.

15 Claims, 3 Drawing Sheets

ADJUSTABLE FASTENER

BACKGROUND OF THE INVENTION

The present invention is generally directed to an adjustable fastener and, more particularly, to an adjustable hanger for removably attaching a photograph, painting, portrait or the like to a wall.

Generally speaking, adjustable fasteners, such as hooks or hangers, are well known. Individuals have long used various hooks or hangers to removably attach one item to another. For example, a multitude of hooks exist to assist individuals in attaching or mounting pictures, posters, photographs, mirrors and the like to a surface, such as a vertically-extending wall.

Adjustable fasteners have several advantages over a conventional nail that extends into a wall and a hanger that engages at least a portion of the nail and extends downwardly therefrom. Such simple, conventional fasteners make it difficult to hang two or more adjacent picture frames at the same height, especially if the back side of the frame includes a conventional generally horizontally-extending twisted metal wire. Another problem with such conventional fasteners is that it can be difficult for one individual to determine an appropriate height to hang a picture without several iterations of hammering the nail into the wall and removing the nail therefrom to adjust the height of the hanger. Adjustable fasteners can alleviate this "trial-and-error" approach of conventional fasteners that often unnecessarily results in multiple, unused punctures in the wall.

One prior art adjustable fastener that appears to overcome some of the above-described disadvantages of conventional fasteners is disclosed in U.S. Patent Application Publication No. 2007/0075211 (Potter). The adjustable hanger disclosed by Potter includes a slide member that is sized and adapted to be slidable received by a support member directly attached to a wall. As shown in FIGS. 1 and 2 of Potter, the support member includes a plurality of holes which can accommodate fasteners, such as nails, screws or the like, to attach the support member to the wall.

Despite the advantages that the device of Potter provides over a conventional fastener, the device of Potter also includes several disadvantages. For example, any fastener extending through a hole in the support member may prevent the slide member from sliding therethrough if the fastener is not placed completely flush with the planar surface of the support member. As a result, the slide member may become stuck in the support member and/or the adjustable functionality of Potter may be prevented. In addition, the generally small slide member of Potter can be difficult to properly position within the support member, and/or it can be difficult for a user to locate or grasp the slide member of Potter when attached to a picture.

Therefore, it would be desirable to create an adjustable fastener that overcomes the above-identified disadvantages of conventional fasteners and the adjustable hanger of Potter. For example, it would be desirable to create an adjustable fastener in which a carriage is slidably mounted within a base, such that the carriage is larger than the base in at least one aspect thereof such that a user can easily grasp and manipulate the carriage. It would also be desirable to create an adjustable fastener which is readily able to be cut with conventional scissors, such that a user can selectively modify the adjustable fastener to be hidden behind a picture hung on a wall. In addition, it would be desirable to create a carriage and base combination in which a nail extending through the base, so as to attach the base to a wall, does not and cannot prevent the carriage from being slidable within the base. The present invention accomplishes the above objectives.

BRIEF SUMMARY OF THE INVENTION

Briefly stated, one aspect of the present invention is directed to an adjustable fastener including a base configured to be fixedly attached to a structure. The base defines a longitudinally extending channel therein. At least a portion of the channel has a plurality of spaced-apart ribs or teeth extending inwardly into the channel. A carriage is movably attached to the base. The carriage is directly attachable to at least a portion of an object. The carriage includes at least two laterally spaced-apart elongated extensions. Each extension has a plurality of complimentary spaced-apart ribs or teeth for engaging the plurality of ribs or teeth of the base to locate and retain the elongated extensions within the channel of the base.

In another aspect, the present invention is directed to an adjustable fastener including a base configured to be fixedly attached to a structure. The base defines a longitudinally extending channel therein. At least a portion of the channel has a plurality of spaced-apart ribs or teeth extending inwardly into the channel. A carriage is moveably attached to the base. The carriage is directly attachable to at least a portion of an object. The carriage includes at least two laterally spaced-apart elongated extensions. Each extension has a plurality of complimentary spaced-apart ribs or teeth for engaging the plurality of ribs or teeth of the base to locate and retain the elongated extensions within the channel of the base. A gap is defined between at least a portion of the extensions. The plurality of complimentary ribs or teeth of the carriage mate with the plurality of ribs or teeth of the base thereby permitting longitudinal movement of the carriage with respect to the base in a first longitudinal direction and prohibiting longitudinal movement of the carriage with respect to the base in a second longitudinal direction opposite to the first longitudinal direction. A length of each extension, as measured along a longitudinal axis thereof, is greater than the length of the base, as measured along a longitudinal axis thereof.

In yet another aspect, the present invention is directed to an adjustable fastener including a base configured to be fixedly attached to a structure. The base defines a longitudinally extending channel therein. At least a portion of the channel has a plurality of spaced-apart ribs or teeth extending inwardly into the channel. A carriage is moveably attached to the base. The carriage is directly attachable to at least a portion of an object. The carriage includes an elongated extension having a plurality of complimentary spaced-apart ribs or teeth for engaging the plurality of ribs or teeth of the base to locate and retain the elongated extension within the channel of the base. A length of the extension, as measured along a longitudinal axis thereof, is greater than the length of the base, as measured along a longitudinal axis thereof.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
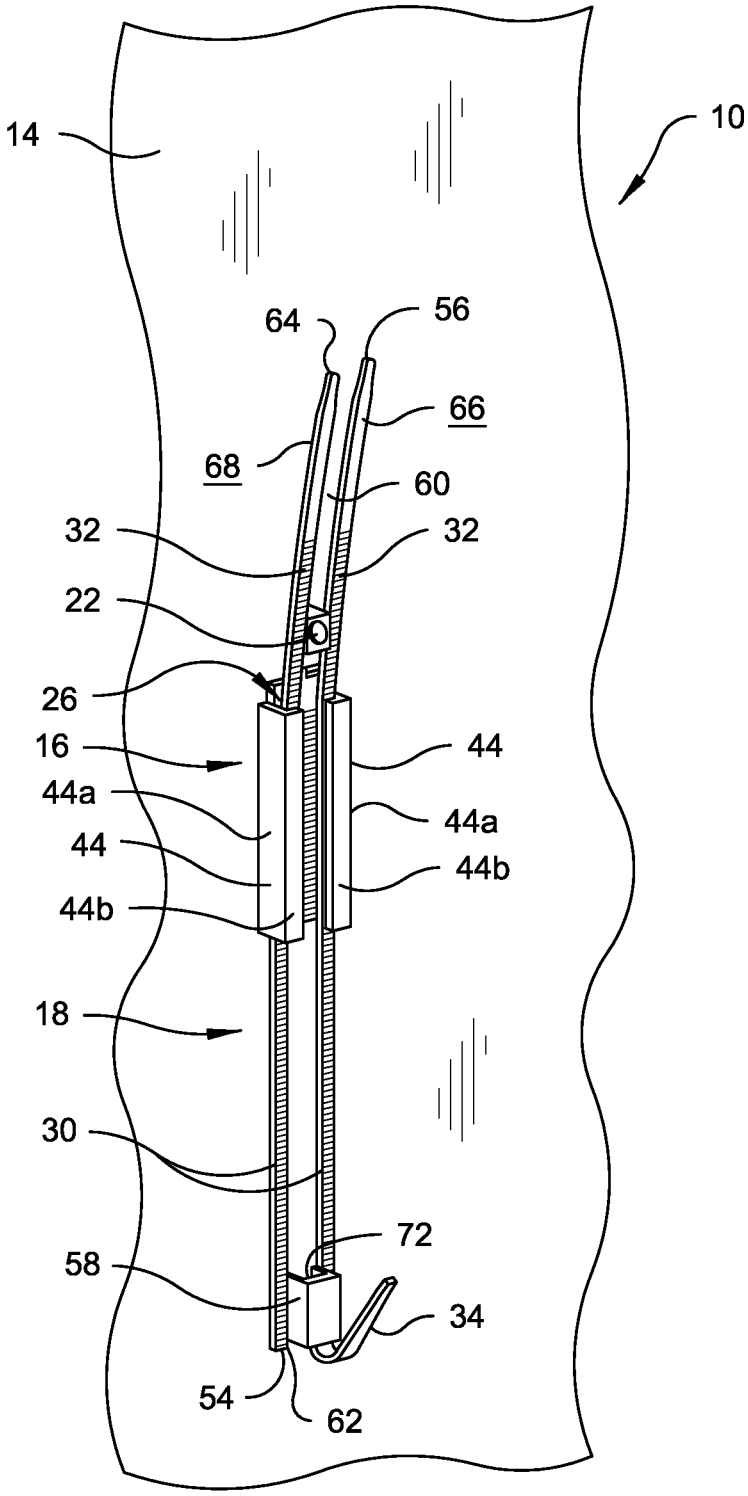
FIG. 1 is a perspective view of an adjustable fastener according to a preferred embodiment of the present invention.

Certain terminology is used in the following description for convenience only and is not limiting. The words "right," "left," "lower," "bottom," "upper," "top," "front" and "rear" designate directions in the drawings to which reference is made. The words "inwardly" and "outwardly" refer to directions toward and away from, respectively, the geometric center of the device, and designated parts thereof, in accordance with the present invention. Unless specifically set forth herein, the terms "a," "an" and "the" are not limited to one element, but instead should be read as meaning "at least one." The terminology includes the words noted above, derivatives thereof and words of similar import.

Figure 2:
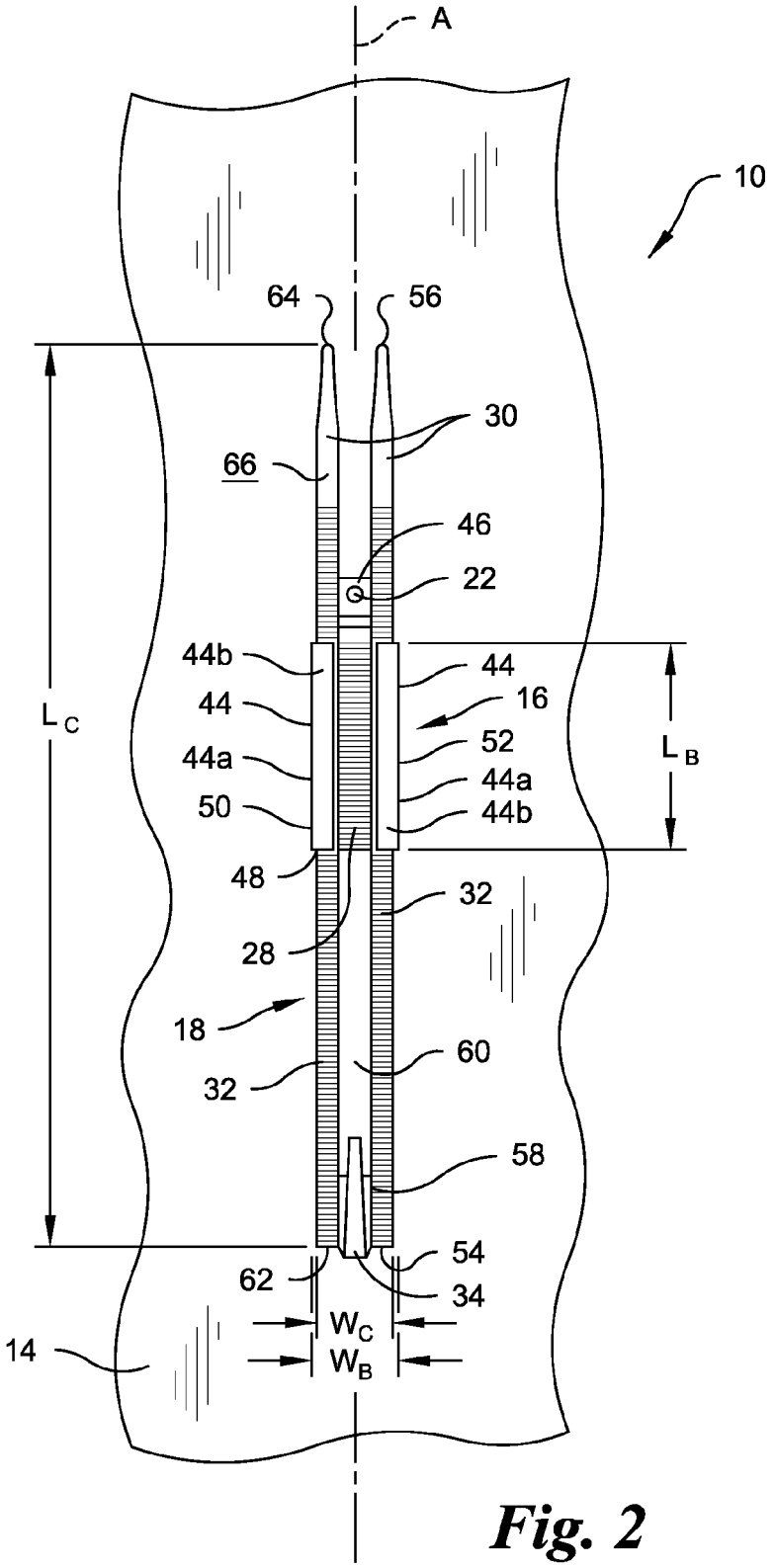
FIG. 2 is a front elevation view thereof.
Figure 3:
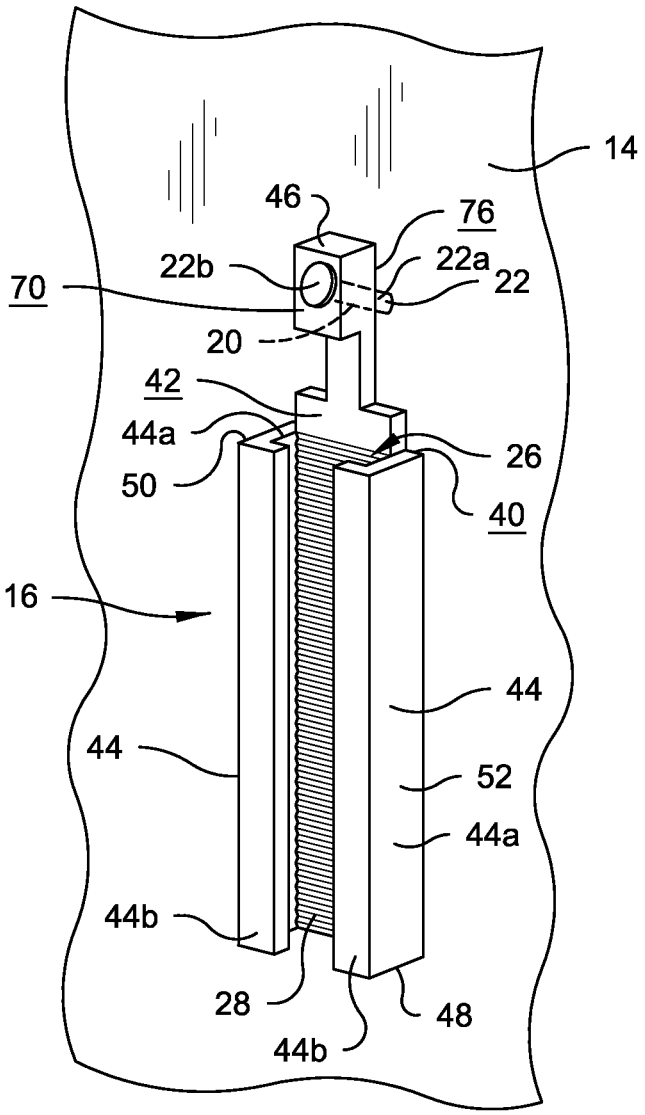
FIG. 3 is a perspective view of a base of the adjustable fastener shown in FIG. 1.

Referring to the drawings in detail, wherein like numerals indicate like elements throughout several views, FIGS. 1-3 show an adjustable fastener, generally designated 10, in accordance with a preferred embodiment of the present invention. The adjustable fastener 10 is preferably a form of a hanger that allows an object to be removably attached or secured to a structure 14, such as a vertically-extending wall in an interior of a house or other building (not shown). As described in detail below, it is preferred that the adjustable fastener 10 is configured to allow a user to attach an object, such as a picture, photograph, poster, portrait, mirror or the like to the structure 14. However, the adjustable fastener 10 is not limited to only attaching objects to a wall, but allows for the adjustable attachment of any two, separate items. The object is not shown in the drawings so as to more clearly depict the adjustable fastener 10 and because those of ordinary skill in the art readily understand how the object would attach to and be supported by the adjustable fastener 10 from the drawings and the below description.

Referring to FIGS. 1-3, the adjustable fastener 10 preferably includes a base 16 configured to be fixedly attached to the structure 14. As shown in FIG. 3, the base 16 includes a first or rear surface 40 that is preferably planar or flat and defines and/or extends in a first plane. The first surface 40 of the base 16 is preferably in generally flush engagement and directly contacts the structure 14 when the base 16 is attached to the structure 14. Thus, the first plane defined by the first surface 40 is preferably generally, if not exactly, parallel to a plane defined by the structure 14 when the base 16 is attached to the structure 14. The base 16 also preferably includes a second or front surface 42 that generally opposes the first surface 40. Similar to the first surface 40, the second surface 42 is preferably generally planar or flat and extends in or defines a second plane that is preferably generally parallel to the plane defined by the structure 14 when the base 16 is attached to the structure 14. The second plane defined by the second surface 42 is preferably spaced-apart a predetermined distance from the first plane defined by the first surface 40 and the plane defined by the structure 14. The second surface 42 of the base 16 preferably generally faces away from the structure 14 when the base 16 is attached to the structure 14.

As shown in FIGS. 1-3, the base 16 preferably includes at least two laterally spaced-apart flanges 44. At least a portion of each flange 44 preferably extends outwardly from and/or beyond the second surface 42 of the base 16. It is preferred that at least a first portion 44*a* of each flange 44 extends generally, if not exactly, perpendicularly to the second plane defined by the second surface 42 of the base 16. In addition, it is preferred that a second portion 44*b* of each flange 44 extends generally, if not exactly, parallel to the first and second planes of the first and second surfaces 40, 42, respectively, of the base 16. As shown in each of the figures, a gap or spacing (not numbered) is preferably defined between an inner end or side of the second portion 44*b* of each flange 44. Thus, it is preferred that the second portions 44*b* of the flanges 44 do not meet or directly engage one another.

Referring to FIGS. 1 and 3, it is preferred that the second surface 42 of the base 16 and an interior surface of each of the first and second portions 44*a*, 44*b* of the flange 44 of the base 16 generally define a channel 26 that extends longitudinally through the base 16. As shown in FIG. 2, a longitudinal axis A of the base 16 preferably extends from a first end or top portion 46 of the base 16 to a second or bottom end 48 of the base 16. As clearly shown in FIG. 3, at least a portion of the first end 46 of the base 16 preferably has a greater thickness than a thickness of the base 16 between the first and second surfaces 40, 42. In other words, at least a portion of the first end 46 of the base 16 preferably extends outwardly from and/or beyond the second surface 42 of the base 16. The greater thickness of the first end 46 allows the first end 46 to more readily and/or repeatedly receive a fastener therethrough, as described in detail below. As such, the first end 46 preferably provides a desirable location to attach the base 16 to the structure 14, as described in detail below. As shown in FIG. 3, a rear surface 76 of the first end 46 of the base 16 may define a plane that is spaced-apart from the first and second planes defined by the first and second surface 40, 42, respectively, of the base 16. Alternatively, at least a portion of the rear surface 76 of the first end 46 of the base 16 may directly engage the structure 14 when the base 16 is attached to the structure 14.

Referring to FIG. 2, a length $L_B$ of the base 16 is preferably measured along the longitudinal axis A of the base 16 from the first end 46 to the second end 48 thereof. A width $W_B$ of the base 16, which is preferably equal to a width of the first and second surfaces 40, 42 of the base 16, is preferably measured from a first or left side 50 of the base 16 to an opposing second or right side 52 of the base 16 and generally perpendicularly to the longitudinal axis A of the base 16. In the preferred embodiment shown in the drawings, the first and second sides 50, 52 of the base 16 are the same distance, or even the same structure, as an exterior surface of the first portion 44*a* of each flange 44. However, the present invention is not so limited.

As shown in FIG. 3, a portion of the base 16 preferably includes a passageway 20 (shown in phantom) extending completely therethrough. The passageway 20 is preferably sized and shaped to receive at least a portion of a fastener 22, such as a nail or screw, therethrough to attach the base 16 to the structure 14. More specifically, it is preferred that a longitudinal axis of the passageway 20 extends generally, if not exactly, perpendicularly to the longitudinal axis A of the base 16. Although it is preferred that the passageway 20 has a circular cross-sectional shape, the passageway 20 may have a generally eccentric cross-sectional shape, such that the passageway 20 could move around and/or be locked onto a portion of the fastener 22.

It is preferred that the passageway 20 is positioned proximate to or extends through a portion of the first end 46 of the base 16. However, the passageway 20 may extend through the base 16 at any location, so long as the passageway 20 may function as described herein. It is preferred that the passageway 20 is large enough to allow a shaft 22*a* of the fastener 22 therethrough, but at least slightly smaller than a head 22*b* of the fastener 22. Thus, in a preferred arrangement, the head of the fastener 22 is preferably generally flush or extends only slightly outwardly from the first end 46 of the base 16 (see FIG. 3). Thus, it is preferred that the head 22*b* of the fastener 22 almost extends in a plane defined by a front surface 70 of the first end 46 of the base 16, but at most preferably extends parallel to the plane of the front surface 70 of the first end 46 of the base 16 and only slightly spaced-apart therefrom. This feature of a preferred embodiment of the present invention provides at least one advantage over the device of Potter described above, since the fastener 22 of the present invention is unlikely to disrupt operation of the present invention, as described in detail below.

Referring again to FIG. 3, it is preferred that at least a portion of the channel 26 has a plurality of spaced-apart ribs or teeth 28 that extend generally inwardly into the channel 26. More specifically, at least a portion of one of the plurality of ribs or teeth 28 of the base 16 is positioned on the interior surface of at least one of the first and second portions 44*a*, 44*b* of each flange 44 of the base 16 and extend at least slightly inwardly into the channel 26. Additionally or alternatively, at least a portion of one of the plurality of ribs or teeth 28 are positioned on the second surface 42 of the base 16 and extend at least slightly outwardly therefrom. It is preferred that the ribs or teeth 28 extend generally parallel to at least the second end 48 of the base 16 and generally perpendicularly to at least one of the first and second sides 50, 52 of the base 16. The ribs or teeth 28 shown in the figures extend from the interior surface of one of the first portions 44*a* of the flanges 44 to the interior surface of the other first portion 44*a* of the other flange 44. However, the present invention is not so limited, as the ribs or teeth 28 may only extend across a portion of the second surface 42 of the base 16.

Each rib or tooth 28 may be in the form of a slightly raised extension that may be generally convex in shape with respect to the second surface 42 of the base 16 and/or the interior surface the first and second portions 44*a*, 44*b* of each flange 44 of the base 16. Adjacent ribs or teeth 28 are preferably equidistantly distanced spaced-apart along the longitudinal axis A of the base 16. Alternatively, the ribs or tooth may be concave in shape with respect to the second surface of the base 16 and/or the interior surface of the first and second portions 44*a*, 44*b* of each flange of each base 16. Furthermore, each rib or tooth 28 may have a generally planar top surface that extends generally perpendicularly outwardly from the second surface 42 of the base 16, and a lower surface that extends at a forty-five degree angle, for example, with respect to the second surface 42 of the base 16.

Referring to FIGS. 1 and 2, the adjustable fastener 10 preferably includes a carriage 18 removably attachable to the base 16 and/or removably insertable through at least a portion of the base 16. The carriage 18 is preferably sized and shaped to pass completely through the channel 26 of the base 16. The carriage 18 is preferably directly attachable to at least a portion of the object to be attached to the structure 14. More specifically, the carriage 18 may include an arcuate member 34 extending outwardly from a plane defined by the carriage 18. When the carriage 18 is moved or slid through the channel 26 of the base 16, the plane defined by the carriage 18 is preferably parallel to the first and second planes defined by the first and second surfaces 40, 42 of the base 16. The arcuate member 34 may be in the form of an upwardly extending hook and is preferably positioned proximate a first or lower end 54 of the carriage 18. However, the present invention is not so limited, as the arcuate member 34 may be positioned proximate a second or upper end 56 of the carriage 18, for example. Furthermore, the arcuate member 34 may be formed of two or more rectilinear portions that form a hook.

As shown in FIG. 2, the carriage 18 includes a bridge or raised portion 58 proximate the first end 54 of the carriage 18. The bridge 58 preferably extends outwardly from the plane defined by the carriage 18 and preferably defines a groove 72 therein. The arcuate member 34 preferably extends outwardly from the bridge 58 on a side opposing the groove 72. The arcuate member 34 may be integrally formed with the bridge 58, but the present invention is not so limited. The groove 72 of the carriage 18 is preferably sized and/or shaped to pass over the fastener 22 and any raised portion of the base 16 when the carriage 18 is moved through the channel 26 of the base 16. More specifically, the bridge 58 is sized and shaped such that the head 22*b* of the fastener 22, when the fastener 22 is inserted in the passageway 20 to attach the base 16 to the structure 14, will not prevent movement of the carriage 18 completely through the channel 26 of the base 16. Even if at least a portion of the fastener 22 inadvertently extends outwardly from the base 16 at a distance further than desired, the groove 72 of the bridge 58 would allow the bridge 58 to pass over the fastener 22. Thus, the bridge 58 of the present invention overcomes the above-described disadvantages of the invention of Potter.

Referring again to FIGS. 1 and 2, the carriage 18 preferably includes at least two laterally spaced-apart elongated extensions 30. The extensions 30 are preferably generally flexible, and preferably at least slightly more flexible than the base 16, but the present invention is not so limited. At least a portion of each extension 30 is separated by a spacing or gap 60 therebetween. As shown in FIG. 2, a length $L_C$ of each extension 30, which is preferably the same as a length of the carriage 18, is preferably measured from a first or lower end 62 of each extension 30 to an opposing second or upper end 64 of each extension 30. It is preferred that the first end 54 of the carriage 18 is the same surface as the first end 62 of each extension 30, and that the second end 56 of the carriage 18 is the same surface as the second end 64 of each extension 30, but the present invention is not so limited. A longitudinal axis A of each extension 30, and, thus, the carriage 18, preferably extends from the first end 62 to the second end 64 thereof. It is preferred that the length $L_C$ of each extension 30 is greater than the length $L_B$ of the base 16. This difference in length allows the user to easily locate and/or grasp the elongated extensions 30 and/or carriage 18 to more easily adjust the object, such as a picture, with respect to the structure 14. In addition, the greater length $L_C$ of each extension 30 may allow at least an upper portion of each extension 30 to extend upwardly beyond a top edge of the object when the object is attached to the arcuate member 34, depending upon the size of the object.

In a preferred embodiment, each extension 30, and, thus, the carriage 18, is preferable formed of a type of material and of a sufficient thickness to be readily capable of being cut with conventional scissors (not shown), for example. For example, each extension 30 may be formed of a polymeric material having a sufficient density that allows a user to relatively easily cut therethrough. However, it is preferred that the material of each extension 30 provides sufficient rigidity to the carriage 18 so that the carriage 18 can be selectively moved through the channel 26 of the base 16. The ability to be cut with conventional scissors, which is not exhibited by the known prior art such as Potter, allows a user to cut any of the portion of the extensions 30 that extend above the object attached to the structure 14. Therefore, after being cut, the adjustable fastener 10 provides an aesthetically pleasing hanger that is virtually invisible or substantially hidden behind the object hung to the structure 14.

In order for the carriage 18 to pass through the channel 26 of the base 16, the carriage 18 preferably has a width $W_C$ (see FIG. 2) at least slightly less than the width $W_B$ of the base 16. More specifically, a distance measured from an outer lateral side wall of one of the extensions 30 to an outer lateral side wall of the other extension 30, as measured generally perpendicularly to the longitudinal axis A of the extensions 30, is preferably less than a width of the second surface 42 of the base 16, as measured generally perpendicularly to the longitudinally axis A of the base 16.

As shown in FIGS. 1 and 2, the extensions 30 preferably extend generally parallel to one another. More specifically, when the carriage 18 is positioned within the channel 26 of the base 16, each extension 30 extends generally parallel to the first and second sides 50, 52 of the base 16. Furthermore, when the carriage 18 is positioned within the channel 26 of the base 16, the first end 46 of the base 16 is preferably positioned between the extensions 30. Thus, the combination of the first end 46 of the base 16 and the flanges 44 of the base 16 preferably properly align the carriage 18 within the base 16. While it is preferred that the carriage 18 includes two separate and laterally spaced-apart extensions 30 with the gap 60 in between at least a portion thereof, the present invention is not so limited. Alternatively, the carriage 18 and extensions 30 may be formed as a single, integral, unitary and monolithically formed piece without any gaps or spacing therebetween.

Referring again to FIGS. 1 and 2, each extension 30 preferably includes a plurality of vertically spaced-apart ribs or teeth 32 for complimentary engaging the plurality of ribs or teeth 28 of the base 16 to locate and retain the elongated extensions 30 within the channel 26 of the base 16. The ribs or teeth 32 of each extension 30 are preferably sized and shaped to complement and/or match the ribs or teeth 28 of the channel 26. The ribs or teeth 32 of the extensions 30 may extend at least slightly outwardly from either or both of at least a portion of a first or front surface 66 of each extension 30 or at least a portion of an opposing second or rear surface 68 of each extension 30. The ribs or teeth 32 may occupy the entire port of the front and rear surfaces 66, 68, or only a portion thereof. The ribs or teeth 32 may also be formed on at least a portion of one or more side edges of each extension 30, which preferably connect the front and rear surfaces 66, 68 and extend generally perpendicularly thereto.

As shown in FIGS. 1 and 2, each rib or tooth 32 may extend parallel to the ground surface (not shown) or the lower end 62 of each extension 30. Alternatively, each rib or tooth 32 may extend at angle, such as thirty degrees, with respect to the ground surface and/or the lower end 62 of each extension 30. In such an alternative embodiment, an end of each rib or tooth 32 of the left extension 30 (from the perspective of FIG. 2) proximate a left side thereof is preferably position below or downwardly from an opposing end thereof proximate a right side of the left extension 30. Conversely, end of each rib or tooth 32 of the right extension 30 (from the perspective of FIG. 2) proximate a right side thereof is preferably position below or downwardly from an opposing end thereof proximate a left side of the right extension 30. The angled orientation of the ribs or teeth 32 may create a better or stronger connection between similarly oriented ribs or teeth 28 of the channel 26.

In operation, it is preferred that the plurality of complimentary ribs or teeth 32 of the carriage 18 mate with the plurality of ribs or teeth 28 of the base 16, thereby permitting longitudinal movement of the carriage 18 with respect to the base 16 in a first longitudinal direction (i.e., upwardly) and prohibiting longitudinal movement of the carriage 18 with respect to the base 16 in a second longitudinal direction (i.e., downwardly) opposite to the first longitudinal direction. Alternatively, the ribs or teeth 28, 32 may be oriented to permit downward movement of the carriage 18 with respect to the base 16, but prevent upward movement.

To hang the object on the structure 14, the user may place the first surface 40 of the base 16 against the structure 14 and then insert at least a portion of a fastener 22 through the passageway 20 of the base 16 and into the structure 14. As described in detail above, it is preferred that the user drives the fastener 22 into the structure 14 a sufficient distance such that the head 22*a* of the fastener 22 is generally flush with the second surface 42 of the base 16. Next, it is preferred that the user inserts the first end 62 of each extension 30 into a lower opening of the channel 26 of the base 16. The extensions 30 are preferably fed or moved upwardly through the channel 26 such that the ribs or teeth 28 of the channel 26 engage the ribs or teeth 32 of the extensions 30. Once the ribs or teeth 28 of the channel 26 engage the ribs or teeth 32 of the extensions 30, the user may release his/her hands from the adjustable fastener 10 without fear that the extensions 30 and/or carriage 18 will fall or drop to a ground surface (not shown). Thus, the engagement of the ribs or teeth 28, 32 suspend the carriage 18 above the ground surface, while also allowing the user to selectively move the carriage 18 upwardly with respect to the base 16. As shown in FIG. 1, in the preferred embodiment at least a portion of the first end 46 of the base 16 may extend outwardly at least slightly beyond the first surface 66 of each extension 30.

Once the user has the carriage 18 in the desired position with respect to the base 16 (as shown in FIGS. 1 and 2, for example), the user can suspend the object from the arcuate member 34. For example, the user may engage a hook, cord/string or opening (none shown) on a rear surface of the object to the arcuate member 34 of the carriage 18. At this point, the user may selectively raise the carriage 18 and thus, the object, by pulling upwardly on a portion of each extension 30 that extends upwardly above the object. If the user determines that the object is too high on the structure 14, the carriage 18 can be pulled upwardly until it is removed from the base 16 and the above-described process of inserting the extensions 30 within the channel 26 can be repeated.

Alternatively, if the user determines that the object is too high on the structure 14, the user could temporarily remove the object from the carriage 18, move the carriage 18 upwardly with respect to the base 16, and then reattach the object to the arcuate member 34 of the carriage 18. The above-described process can be repeated until the desired height of the object on the structure 14 is obtained. Once the desired height of the object is obtained, any portion of either or both extensions 30 that extend above the object can be cut with the conventional scissors, for example, to completely sever any upper portion of each extension 30 so that the adjustable fastener 10 is at least substantially hidden or virtually invisible behind the object.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An adjustable fastener comprising:

a base configured to be fixedly attached to a structure, the base defining a longitudinally extending channel therein, at least a portion of the channel having a plurality of spaced-apart ribs or teeth extending inwardly into the channel; and a carriage movably attached to the base, the carriage being directly attachable to at least a portion of an object, the carriage including at least two laterally spaced-apart elongated extensions, each extension having a plurality of complementary spaced-apart ribs or teeth for engaging the plurality of ribs or teeth of the base to locate and retain the elongated extensions within the channel of the base, the elongated extensions connected at a first end by a bridge, wherein the bridge extends outwardly from a plane defined by the extensions, the bridge defining a groove, an arcuate member extending from the bridge outwardly from the plane defined by the extensions.

2. The adjustable fastener of claim 1, wherein the base further includes:

a first surface in generally flush engagement with the structure when the base is attached to the structure;

an opposing second surface generally facing away from the structure when the base is attached to the structure; and at least two spaced-apart flanges extending outwardly from the second surface of the base, the second surface and an interior surface of each flange generally defining the channel.

3. The adjustable fastener of claim 2, wherein at least a portion of one of the plurality of ribs or teeth of the base is positioned on an interior surface of at least one of the flanges.

4. The adjustable fastener of claim 2, wherein a distance from an outer sidewall of one extension to an outer sidewall of another extension, as measured generally perpendicularly to a longitudinal axis of the extensions, is less than a width of the second surface of the base, as measured generally perpendicularly to a longitudinal axis of the base.

5. The adjustable fastener of claim 1, wherein the arcuate member is positioned proximate the first end.

6. The adjustable fastener of claim 1, wherein a gap is defined between at least a portion of the extensions.

7. The adjustable fastener of claim 1, wherein the carriage is sized and shaped to pass completely through the channel.

8. The adjustable fastener of claim 1, wherein a length of each extension, as measured along a longitudinal axis thereof, is greater than a length of the base, as measured along the longitudinal axis thereof.

9. The adjustable fastener of claim 1, wherein each extension is formed of a material and of a sufficient thickness to be readily capable of being cut with conventional scissors.

10. The adjustable fastener of claim 1, wherein the plurality of complementary ribs or teeth of the carriage mate with the plurality of ribs or teeth of the base thereby permitting longitudinal movement of the carriage with respect to the base in a first longitudinal direction and prohibiting longitudinal movement of the carriage with respect to the base in a second longitudinal direction opposite to the first longitudinal direction.

11. The adjustable fastener of claim 1, wherein a portion of the base includes a passageway extending completely therethrough, the passageway being sized and shaped to receive a fastener to attach the base to the structure.

12. The adjustable fastener of claim 1, wherein the extensions extend generally parallel to one another.

13. An adjustable fastener comprising:

a base configured to be fixedly attached to a structure, the base defining a longitudinally extending channel therein, at least a portion of the channel having a plurality of spaced-apart ribs or teeth extending inwardly into the channel; and a carriage movably attached to the base, the carriage being directly attachable to at least a portion of an object, the carriage including at least two laterally spaced-apart elongated extensions connected by a bridge, each extension having a plurality of complementary spaced-apart ribs or teeth for engaging the plurality of ribs or teeth of the base to locate and retain the elongated extensions within the channel of the base, the extensions extend generally parallel to each other, a gap being defined between at least a portion of the extensions, the bridge having a bridge width that is substantially same as a gap width of the gap, wherein the plurality of complementary ribs or teeth of the carriage mate with the plurality of ribs or teeth of the base thereby permitting longitudinal movement of the carriage with respect to the base in a first longitudinal direction and prohibiting longitudinal movement of the carriage with respect to the base in a second longitudinal direction opposite to the first longitudinal direction, wherein a length of each extension, as measured along a longitudinal axis thereof, is greater than a length of the base, as measured along a longitudinal axis thereof, the bridge comprises a raised portion extending outwardly from a plane defined by the extensions, the raised portion defining a groove, an arcuate member extending from the raised portion outwardly from the plane defined by the extensions.

14. An adjustable fastener comprising:

a base configured to be fixedly attached to a structure, the base defining a longitudinally extending channel therein, at least a portion of the channel having a plurality of spaced-apart ribs or teeth extending inwardly into the channel; and a carriage movably attached to the base, the carriage being directly attachable to at least a portion of an object, the carriage including an elongated extension having a plurality of complementary spaced-apart ribs or teeth for engaging the plurality of ribs or teeth of the base to locate and retain the elongated extension within the channel of the base, the carriage comprised of two laterally spaced-apart elongated extensions connected by a bridge at a first end, the bridge comprises an arcuate member extending outwardly from a plane defined by the extensions, the elongated extensions configured for passing through the channel in operation, wherein a length of the extension, as measured along a longitudinal axis thereof, is greater than a length of the base, as measured along a longitudinal axis thereof.

15. The adjustable fastener of claim 14, wherein the plurality of complementary ribs or teeth of the carriage mate with the plurality of ribs or teeth of the base thereby permitting longitudinal movement of the carriage with respect to the base in a first longitudinal direction and prohibiting longitudinal movement of the carriage with respect to the base in a second longitudinal direction opposite to the first longitudinal direction.

* * * * *